US010591259B1

(12) United States Patent
Hatfield

(10) Patent No.: US 10,591,259 B1
(45) Date of Patent: Mar. 17, 2020

(54) SELF-HEALING REACTIVE SHOOTING TARGET

(71) Applicant: James Hatfield, Charlotte, NC (US)

(72) Inventor: James Hatfield, Charlotte, NC (US)

( * ) Notice: Subject to any disclaimer, the term of this patent is extended or adjusted under 35 U.S.C. 154(b) by 0 days.

(21) Appl. No.: 16/404,670

(22) Filed: May 6, 2019

(51) Int. Cl.
*F41J 7/04* (2006.01)
*F41J 1/10* (2006.01)

(52) U.S. Cl.
CPC .. *F41J 7/04* (2013.01); *F41J 1/10* (2013.01)

(58) Field of Classification Search
CPC ..... F41J 7/00; F41J 7/04
USPC ..... 273/390–392, 403–408
See application file for complete search history.

(56) References Cited

U.S. PATENT DOCUMENTS 2,085,933 A * 7/1937 Vaughan ..... F41J 7/04 273/388
2,691,526 A * 10/1954 Wesley ..... A63F 9/0204 273/359
2,777,695 A * 1/1957 Cohn ..... F41J 7/04 273/386
3,845,957 A * 11/1974 Lohr ..... A63F 9/0243 273/389
4,066,261 A * 1/1978 Stewart ..... F41J 1/01 273/403
4,426,085 A * 1/1984 Dixon ..... F41J 7/04 273/375
4,588,194 A * 5/1986 Steidle ..... F41J 7/04 273/391
5,540,446 A * 7/1996 Felsen ..... F41J 3/00 273/403
5,603,505 A * 2/1997 Acock ..... F41J 7/06 273/391
6,478,301 B1 * 11/2002 Witmeyer ..... F41J 7/04 273/378
7,114,725 B2 * 10/2006 Camp ..... F41J 1/10 273/390
7,175,181 B1 * 2/2007 Bateman ..... F41J 7/04 273/392
8,413,991 B2 * 4/2013 Sudbeck ..... F41J 7/04 273/392
8,807,570 B1 * 8/2014 Zalar ..... F41J 7/04 273/390
2008/0185786 A1 * 8/2008 Loveland ..... F41J 7/04 273/391
2014/0027982 A1 * 1/2014 Chiu ..... F41J 9/00 273/359
2014/0091527 A1 * 4/2014 Schneider ..... F41J 1/10 273/407
2015/0198426 A1 * 7/2015 Roberts ..... F41J 7/04 273/390
2017/0284774 A1 * 10/2017 Burks ..... F41J 1/10
2018/0299232 A1 * 10/2018 Thompson ..... F41J 1/10

* cited by examiner

*Primary Examiner* — Mark S Graham
(74) *Attorney, Agent, or Firm* — Jeffrey C. Watson; Mathew L. Grell; Grell & Watson Patent Attorneys LLC

(57) ABSTRACT

A self-healing reactive target includes a target apparatus and a target holder. The target apparatus is a solid one-piece target apparatus made from a self-healing material. The target holder is configured to hold the one-piece target apparatus. The target holder is made from a tear resistant material. Wherein, the solid one-piece target is configured to move about the target holder for providing reactive feedback when shot. Wherein the solid one-piece target apparatus is configured to spin within the target holder for providing instant feedback when shot.

17 Claims, 8 Drawing Sheets

SELF-HEALING REACTIVE SHOOTING TARGET

FIELD OF THE DISCLOSURE

The present disclosure relates to a shooting target. More specifically, the present disclosure is directed toward a self-healing reactive shooting target.

BACKGROUND

Generally speaking, shooting targets are objects in various forms and shapes that are used for pistol, rifle, shotgun and other shooting sports, as well as in darts, target archery, crossbow shooting and other non-firearm related sports. The center is often called the bullseye. Targets can for instance be made of paper, rubber or steel. There are also electronic targets that electronically can provide the shooter with precise feedback of the shot placement. Civilian targets are usually made of paper or a plastic corflute, sometimes with a canvas or hessian back on the larger long-range types. Most competitive targets are a solid black circle on a white background. The black circle may have scoring rings. Targets of other shapes may also be used, like for use with pistol (hand gun) target shooting. Reactive targets, or targets that move when struck, allow shooters to easily identify bullet strikes. This allows shooters to improve their skills by quickly being able to compare their aiming point and where the actual bullet impacted the target. Other target types include a metal plate that is knocked over by the bullet such as in the air rifle sport of field target or handgun discipline of IPSC, and stationary metal plates of scaled animal outlines on which bullet strikes mark as well as those that mark the paint which is painted over again after scoring.

A shooting range, firing range or gun range is a specialized facility designed for firearms qualifications, training or practice. Indoor shooting ranges typically have paper targets that are attached on a retrieval system that can be moved back and forth in the range for longer and shorter practice, and for retrieval, inspection and replacement of the target.

A shooting gallery, on the other hand, is a recreational shooting facility with very low-powered guns, often located within amusement parks, arcades, carnivals or fairgrounds that provide games and entertainments for the visiting crowd. Shooting galleries typically have reactive targets that spin or provide immediate feedback to the shooter of a hit or miss. This immediate feedback is not only beneficial to teaching accuracy but is also entertaining to the shooter. However, these entertaining reactive targets are designed for the low-powered guns of shooting galleries and thus cannot be used in shooting ranges or outside with real weapons or firearms. As such, there is clearly a need to provide a reactive shooting target that can be used in shooting ranges or outside with real weapons to provide immediate feedback of accuracy that is also fun and entertaining to use.

The instant disclosure may be designed to address certain aspects of the needs and/or problems discussed above by providing a self-healing reactive shooting target.

SUMMARY

In accordance with at least select embodiments, the instant disclosure may address at least certain aspects of the above-mentioned needs, issues and/or problems and may provide a self-healing reactive shooting target. In general, the disclosed self-healing reactive shooting target may include a target apparatus and a target holder. The target apparatus may be a solid one-piece target apparatus made from a self-healing material. The target holder may be configured to hold the one-piece target apparatus. The target holder may be made from a tear resistant material. Wherein, the solid one-piece target apparatus may be configured to move about the target holder for providing reactive feedback when shot.

One feature of the instant disclosure of a self-healing reactive shooting target may be that the solid one-piece target apparatus may be configured to spin within the target holder for providing instant feedback when shot.

In select embodiments of the self-healing reactive shooting target disclosed herein, the solid one-piece target apparatus may include a central portion. The central portion may include a left extended member and a right extended member. The left extended member may extend from a left side of the central portion. The right extended member may extend from a right side of the central portion. Wherein, the left extended member and the right extended member may be configured for positioning the solid one-piece target apparatus in the target holder.

In select embodiments of the self-healing reactive shooting target disclosed herein, the left extended member may have a left cylindrical shape, and the right extended member may have a right cylindrical shape. Wherein, the left cylindrical shape of the left extended member may be configured to be inserted into a left pivot hole of the target holder, and the right cylindrical shape of the right extended member may be configured to be inserted into a right pivot hole of the target holder.

Another feature of the disclosed self-healing reactive shooting target disclosed herein may be that the solid one-piece target apparatus may be configured to spin about the target holder via the left cylindrical shape of the left extended member rotating in the left pivot hole of the target holder, and the right cylindrical shape of the right extended member rotating in the right pivot hole of the target holder.

In select embodiments of the disclosed self-healing reactive shooting target disclosed herein, the central portion may include a middle member. The middle member may be positioned between and may interconnect the left extended member with the right extended member. In select embodiments, the middle member may have a middle cylindrical shape. In select embodiments, the middle cylindrical shape may be larger than the left cylindrical shape of the left extended member and the right cylindrical shape of the right extended member.

Another feature of the disclosed self-healing reactive shooting target disclosed herein may be the inclusion of a left protruding ring and a right protruding ring. The left protruding ring may be positioned between the left cylindrical shape of the left extended member and the middle cylindrical shape of the middle member. The left protruding ring may be sized larger than the left pivot hole of the target holder where the left protruding ring may not go through the left pivot hole of the target holder. The right protruding ring may be positioned between the right cylindrical shape of the right extended member and the middle cylindrical shape of the middle member. The right protruding ring may be sized larger than the right pivot hole of the target holder where the right protruding ring may not go through the right pivot hole of the target holder. As a result, the combination of the left protruding ring and the right protruding may be configured to center and maintain the solid one-piece target apparatus in the target holder.

One feature of the self-healing reactive shooting target disclosed herein may be that a first target may extend from a first side of the central portion, and a second target may extend from a second side of the central portion.

In select embodiments of the disclosed self-healing reactive shooting target disclosed herein, the first side with the first target extending therefrom may be opposed 180 degrees from the second side with the second target extending therefrom. Whereby, the first target extends in an opposite direction from the central portion of the second target. In select embodiments, the first target may include a first spacing member configured to connect the first target to the first side of the central portion at a first distance from the central portion, and the second target may include a second spacing member configured to connect the second target to the second side of the central portion at a second distance from the central portion. Wherein the first target with the first spacing member may be sized 15-20% lighter than the second target with the second spacing member, whereby the solid one-piece target apparatus spins evenly about the central portion and returns to a vertical position after being shot.

Another feature of the disclosed self-healing reactive shooting target disclosed herein may be that the first target may be shaped, designed, or a combination thereof different from the second target. In select embodiments, the first target may have a circular shape with a circular target design and the second target may have a square shape with a square target design. In select other embodiments, the first target may have an octagon shape with a stop sign design and the second target may have the square shape with a railroad crossing design. In yet other select embodiments, the first target may have a duck shape with a duck design, and the second target may have the circular shape with the circular target design. In yet other select embodiments, the first target may have a highway sign shape with a route design, and the second target may have the square shape with the square target design. In yet other select embodiments, the first target and/or the second target may have any various combinations of shapes and designs.

Another feature of the disclosed self-healing reactive shooting target disclosed herein may be that the self-healing material of the solid one-piece target apparatus may be a polyurethane material. In select embodiments, the self-healing polyurethane material may be cast into the shape and design of the solid one-piece target apparatus. In other select embodiments, the self-healing polyurethane material may include: a hardness of 89-90 A or approximate thereto; a 100% modulus of 1100 psi or approximate thereto; a 300% modulus of 1300 psi or approximate thereto; a tensile of 3000 psi or approximate thereto; an elongation percentage of 530% or approximate thereto; a tear resistance with a split of 70 pli and a Die C of 450 pli or approximate thereto; a compression set percentage of 19% with a method B of 25% deflection at 22 hours and 70° C. or approximate thereto; a rebound percentage of 59% or approximate thereto; and/or a specific gravity of 1.06 or approximate thereto.

Another feature of the disclosed self-healing reactive shooting target disclosed herein may be that the tear resistant material of the target holder may include a base foam with a higher density foam laminated to one side. In select embodiments, the target holder may include a base rectangular shape with an hourglass shaped cutout centered therein. In this embodiment, a left hinging member with a left pivot hole therethrough may be created from a left convex portion created by a left hourglass side of the hourglass cutout. To create this left hinging member, just the base foam and not the higher density foam laminated to one side may be cut to create the left hinging member that hinges via an uncut left section of the higher density foam. Likewise, a right hinging member with a right pivot hole therethrough may be created from a right convex portion created by a right hourglass side of the hourglass cutout. To create this right hinging member, just the base foam and not the higher density foam laminated to one side is cut to create the right hinging member that hinges via an uncut right section of higher density foam. As a result, when the left hinging member and the right hinging member are folded down, the target holder may be in a flat position for storage or transportation. And when the left hinging member and the right hinging member are folded out, the target holder may be in a target receiving position. The target receiving position may be where the left pivot hole of the left hinging member may be configured to receive a left extended member of the central portion of the solid one-piece target apparatus and the right pivot hole of the right hinging member may be configured to receive a right extended member of the central portion of the solid one-piece target apparatus.

In select embodiments of the disclosed self-healing reactive shooting target disclosed herein, a frame may be included. The frame may be configured to surround the target holder and provide support or rigidity to the target holder.

One feature of the disclosed self-healing reactive shooting target disclosed herein may be that the frame can include a hanging portion. The hanging portion may extend from a top of the frame. The hanging portion may be configured to hang the self-healing reactive target to multiple indoor gun range retrieval systems. In select embodiments, the hanging portion of the frame may include a first wide extension portion with a pair of wide holes. The first wide extension portion may extend off of the top of the frame. In select embodiments, a second extension portion may be included with the hanging portion of the frame. The second extension portion may extend off of the first wide extension portion. In select embodiments, the second extension portion may include a first slot, a second slot, and a third slot therethrough.

Another feature of the disclosed self-healing reactive shooting target disclosed herein may be the inclusion of a cutting grid on the hanging portion of the frame. In select embodiments, the cutting grid may include a first dashed cutting line, a second dashed cutting line, a third dashed cutting line and a fourth dashed cutting line. The first dashed cutting line may be for indicating a first cutting location for cutting the hanging portion for use with the wide holes on the first wide extension. The second dashed cutting line may be for indicating a second cutting location for cutting the hanging portion for use with the first slot. The third dashed cutting line may be for indicating a third cutting location for cutting the hanging portion for use with the second slot. The fourth dashed cutting line may be for indicating a fourth cutting location for cutting the hanging portion for use with the third slot.

In select embodiments of the disclosed self-healing reactive shooting target disclosed herein, the frame may be made from cardboard. In select embodiments, the cardboard frame may include a folded bottom side, a folded right side, and a folded left side. The combination of the folded bottom side, the folded right side, and the folded left side may create a holder slot configured for receiving the target holder.

Yet another feature of the disclosed self-healing reactive shooting target disclosed herein may be that it can be configured for safe use inside an indoor gun range where the entire self-healing reactive target may be configured to not ricochet bullets.

In another aspect, the instant disclosure embraces a self-healing reactive target kit. The kit may include the solid one-piece target apparatus in any of the various embodiments shown and/or described herein, the target holder in any of the various embodiments shown and/or described herein, the frame in any of the various embodiments shown and/or described herein, and a target box. As such, the solid one-piece target apparatus may be made from a self-healing material. The target holder may be configured to hold the one-piece target apparatus and may be made from a tear resistant foam material. The frame may be configured to surround the target holder and provide support or rigidity to the target holder. The target box may be configured to store the solid one-piece target apparatus during transportation, storage or for displaying for purchase, rental, or the like. Wherein, the solid one-piece target apparatus may be configured to move about the target holder for providing reactive feedback when shot.

In select embodiments of the disclosed self-healing reactive shooting target kit disclosed herein the target box may be made from cardboard.

In other select embodiments of the disclosed self-healing reactive shooting target kit disclosed herein the target box may include a top edge, a bottom edge, a left edge, a right edge and a backing. The left edge may have a left box hole configured to receive a left extended member of the solid one-piece target apparatus. The right edge may have a right box hole configured to receive a right extended member of the solid one-piece target apparatus. The backing may have a left box slot configured to receive a left protruding ring of the solid one-piece target apparatus, and a right box slot configured to receive a right protruding ring of the solid one-piece target apparatus. Wherein, the target box is configured to securely house the solid one-piece target apparatus.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
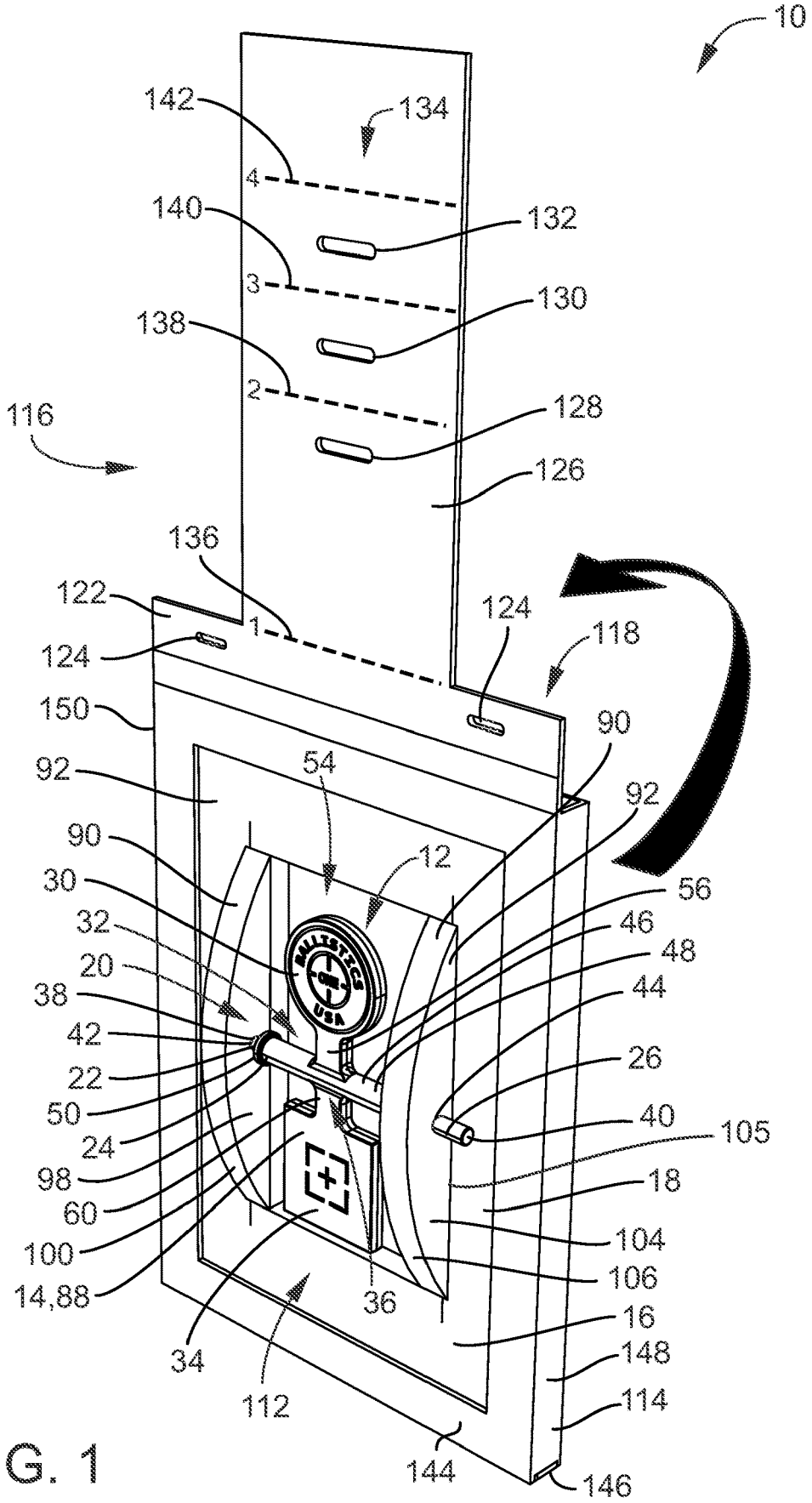
FIG. 1 is a front perspective view of the self-healing reactive shooting target according to select embodiments of the instant disclosure.
Figure 2:
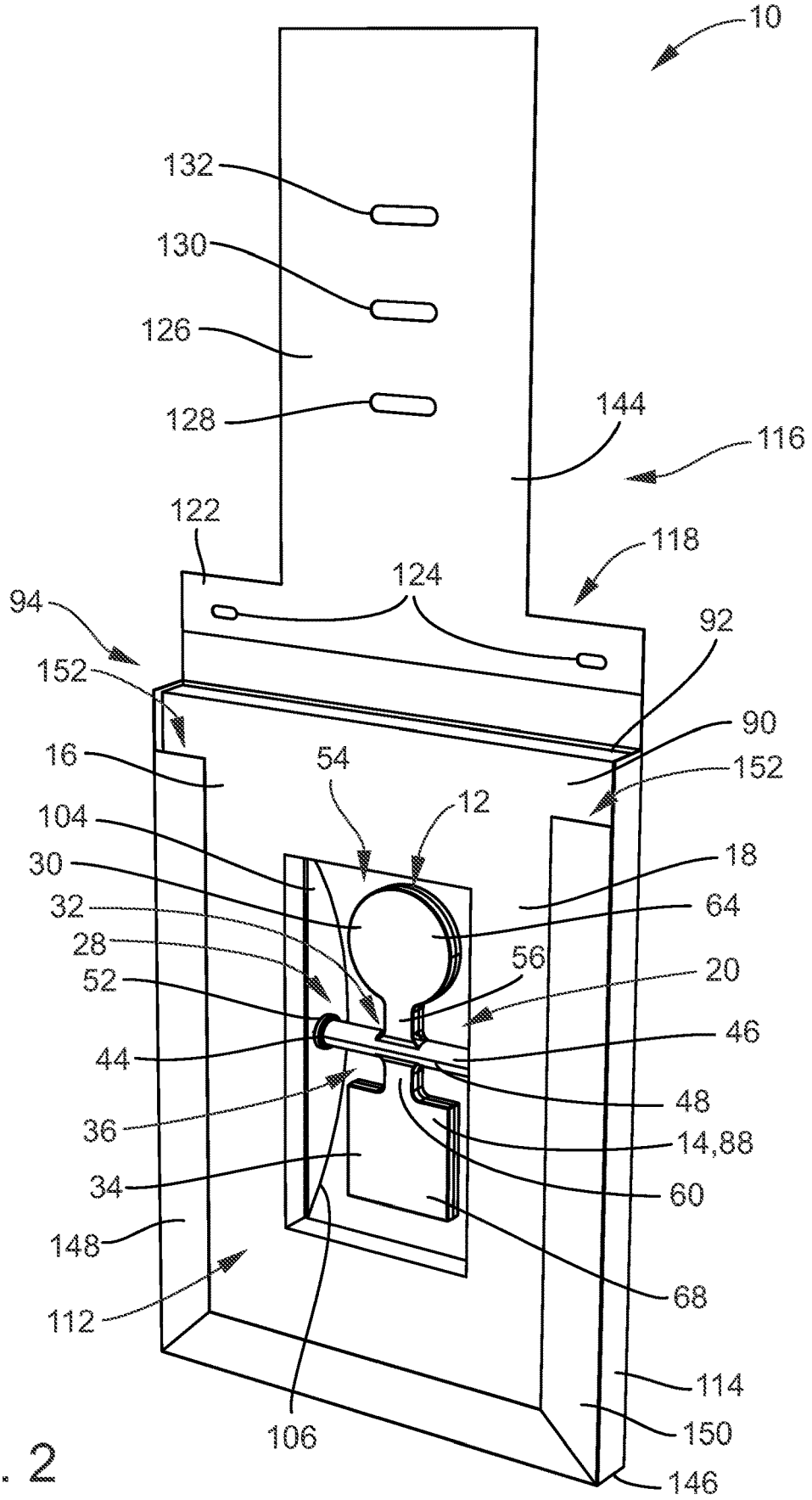
FIG. 2 is a back perspective view of the self-healing reactive shooting target of FIG. 1.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-8, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-6, in a possibly preferred embodiment, the present disclosure overcomes the above-mentioned disadvantages and meets the recognized need for such an apparatus or method by providing of self-healing reactive shooting target 10. Self-healing reactive shooting target 10 may be for providing a reactive or interactive target for aim practice with various weapons, rifles, handguns, or the like, that is entertaining to use, provide immediate feedback of accuracy of target hit, and is durable enough to be used with real weapons, rifles, handguns, or the like where it can withstand multiple hits at any location on the self-healing reactive shooting target 10. In general, the disclosed self-healing reactive shooting target 10 may include target apparatus 12 and target holder 16, as shown in FIGS. 1-4 and 6. These components of self-healing reactive shooting target 10 will be discussed in greater detail below.

Target apparatus 12 may be included with self-healing reactive shooting target 10. See FIGS. 1-8 and shown in various detailed embodiments in FIGS. 5A-5D. Target apparatus 12 may be for providing the main self-healing target device or apparatus that is designed to be shot and provides a reactive motion once shot. Target apparatus 12 may be constructed from various materials and methods. In select embodiments, target apparatus 12 may be constructed from a solid one-piece material where all components of target apparatus 12 are integrally formed. However, the disclosure is not so limited, and other means for creating target apparatus 12 may be utilized. Target apparatus 12 may be made from self-healing material 14. Self-healing material 14 may be designed so that bullets or the like may penetrate through target apparatus 12, where the self-healing material 14 may allow the bullet or the like to pass through and then close up the hole immediately thereafter, or substantially close up the hole immediately thereafter, i.e. self-healing target apparatus 12. In select embodiments, self-healing material 14 of solid one-piece target apparatus 12 may be polyurethane material 88. Polyurethane material 88 may be any polyurethane material, or the like, that is self-healing or the like. In select embodiments, the self-healing polyurethane material 88 may be cast into the shape and design of solid one-piece target apparatus 12 for integrally forming all of the components of target apparatus 12 in a solid one-piece member. In other select embodiments, self-healing polyurethane material 88, or other like material, may be made from other various methods for creating solid one-piece target apparatus 12, including but not limited to, injection molding, like with plastic pellets including thermoplastic polyurethane or TPU plastic pellets. As an example, and clearly not limited thereto, in select possibly preferred embodiments, self-healing polyurethane material 88 may include: a hardness of 89-90 A or approximate thereto; a 100% modulus of 1100 psi or approximate thereto; a 300% modulus of 1300 psi or approximate thereto; a tensile of 3000 psi or approximate thereto; an elongation percentage of 530% or approximate thereto; a tear resistance with a split of 70 pli and a Die C of 450 pli or approximate thereto; a compression set percentage of 19% with a method B of 25% deflection at 22 hours and 70° C. or approximate thereto; a rebound percentage of 59% or approximate thereto; and/or a specific gravity of 1.06 or approximate thereto. As a specific example, polyurethane material 88 of target apparatus 12 may be PC1E90B1 provided by Polymer Components Innovate Solutions of Benton, Tenn.

Referring now specifically to FIGS. 5A-5D, various embodiments of solid one-piece target apparatus 12 are shown. As shown in each of these Figures, in select embodiments of self-healing reactive shooting target 10, solid one-piece target apparatus 12 may include central portion 20. Central portion 20 may include left extended member 22 and right extended member 26. Left extended member 22 may extend from left side 24 of central portion 20. Right extended member 26 may extend from right side 28 of central portion 20. Wherein, left extended member 22 and right extended member 26 may be configured for positioning solid one-piece target apparatus 12 in target holder 16, as shown in FIGS. 1-4 and 6. In select embodiments of self-healing reactive shooting target 10 disclosed herein, left extended member 22 may have left cylindrical shape 38, and right extended member 26 may have right cylindrical shape 40. Wherein, left cylindrical shape 38 of left extended member 22 may be configured to be inserted into left pivot hole 42 of target holder 16, and right cylindrical shape 40 of right extended member 26 may be configured to be inserted into right pivot hole 44 of target holder 16, as shown specifically in FIG. 3. With this configuration, solid one-piece target apparatus 12 may be configured to spin about target holder 16 via left cylindrical shape 38 of left extended member 22 rotating in left pivot hole 42 of target holder 16, and right cylindrical shape 40 of right extended member 26 rotating in right pivot hole 44 of target holder 16.

Central portion 20 of target apparatus 12 may include middle member 46. Middle member 46 may be positioned between and may interconnect left extended member 22 with right extended member 26. In select embodiments, middle member 46 may have middle cylindrical shape 48. With the combination of middle cylindrical shape 48 of middle member 46, left cylindrical shape 38 of left extended member 22 and right cylindrical shape 40 of right extended member 26, central portion 20 of target apparatus 12 may provide a rod shape or rod type configuration throughout the center of target apparatus 12. This rod shape may be integral with all of the components of target apparatus 12 and may thus provide the central axis that target apparatus 12 spins about, i.e. the rod shape of middle member 46 rotates for spinning target apparatus 12. In select embodiments, middle cylindrical shape 48 may be larger than left cylindrical shape 38 of left extended member 22 and right cylindrical shape 40 of right extended member 26. This larger feature of middle cylindrical shape 48 may provide the needed support and structure for middle member 22, like for being shot multiple times through central portion 20.

Figure 3:
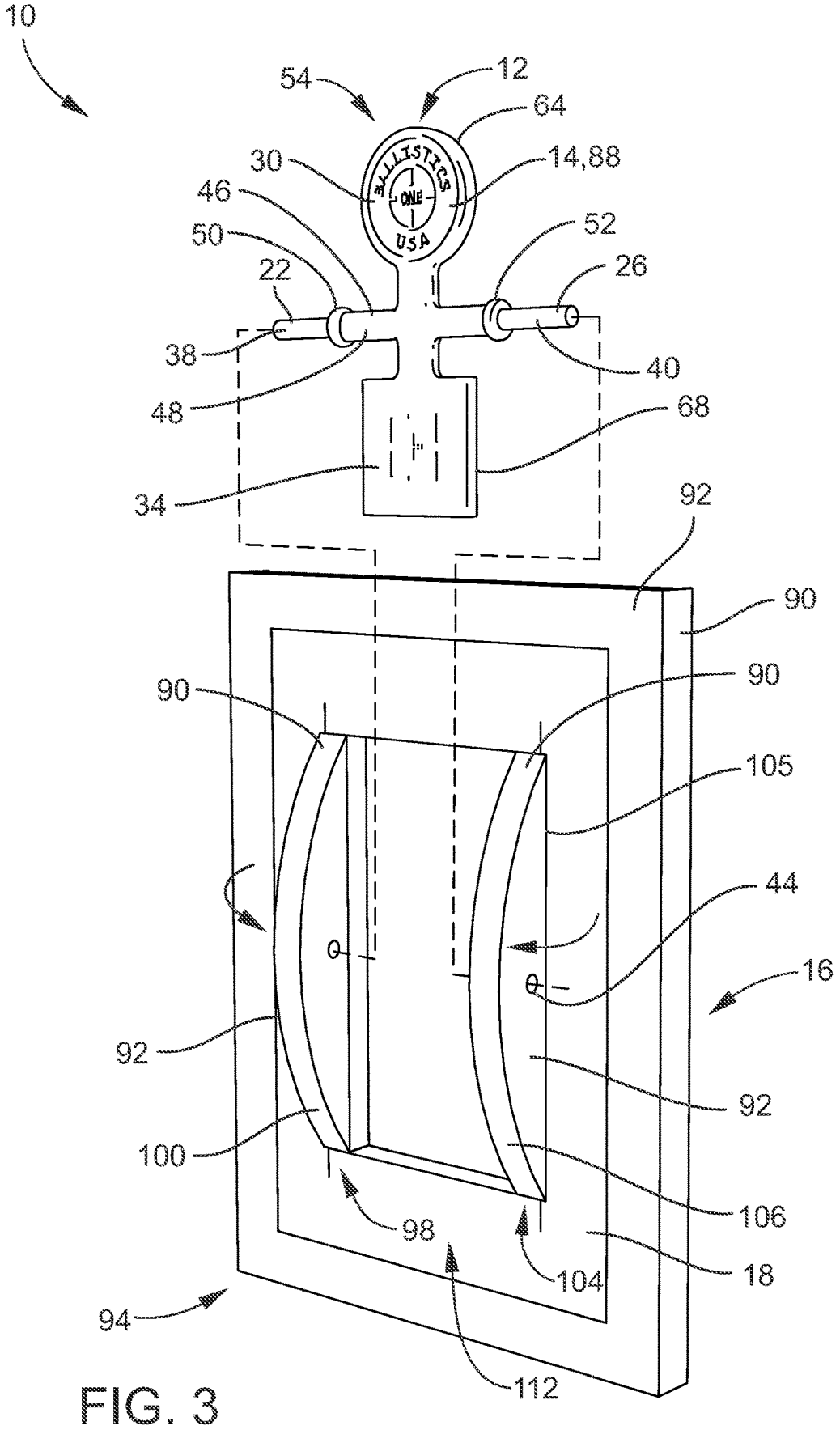
FIG. 3 is a front perspective view of the self-healing reactive shooting target showing how the solid one-piece target apparatus is inserted into the target holder.
Figure 4:
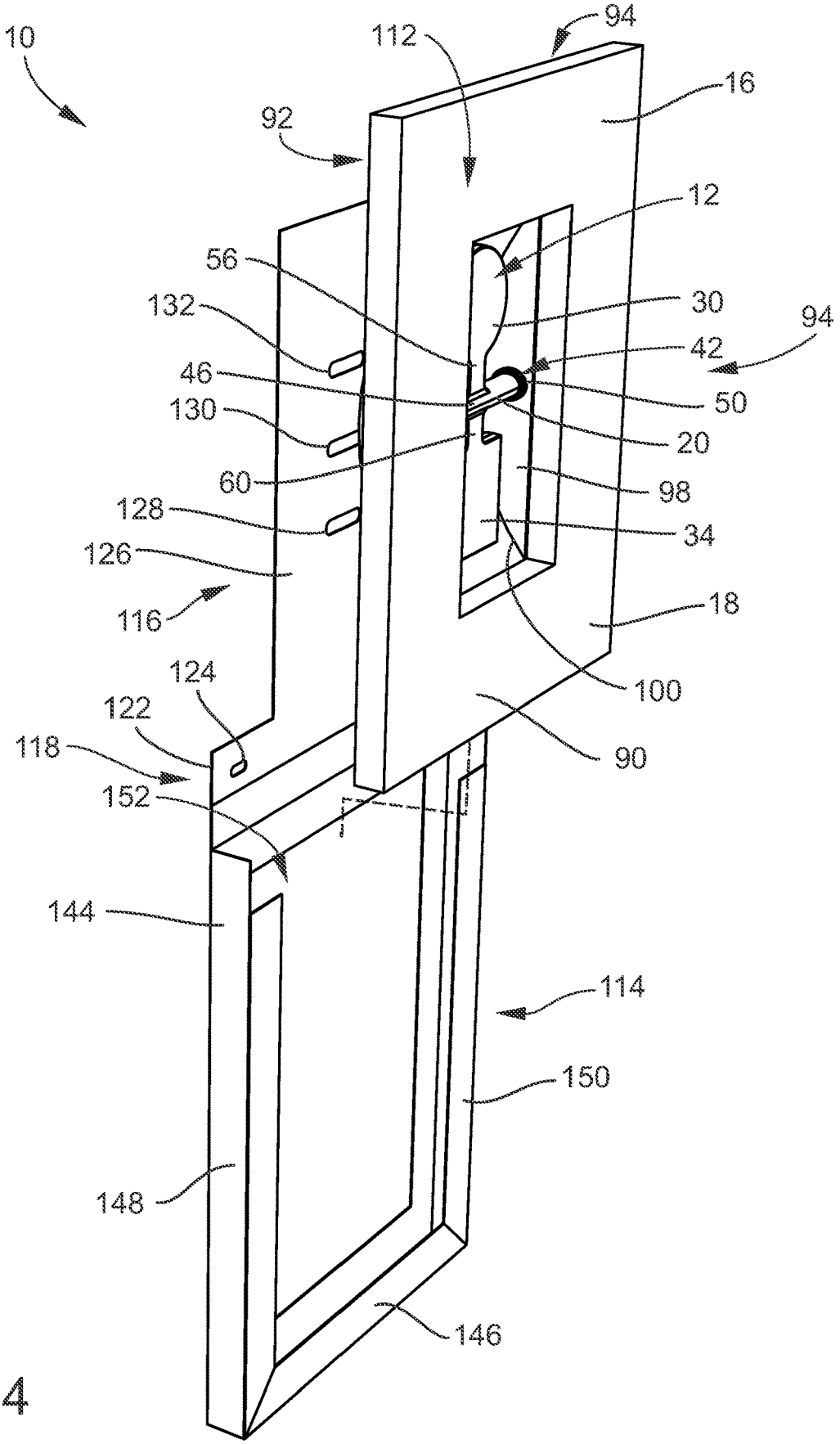
FIG. 4 is a back perspective view of the self-healing reactive shooting target from FIG. 1 showing how the target holder with the solid one-piece target apparatus inserted therein is inserted into the holder slot of the frame.

As shown best in FIGS. 3 and 5, left protruding ring 50 and right protruding ring 52 may be included in select embodiments of target apparatus 12. Left protruding ring 50 may be positioned between left cylindrical shape 38 of left extended member 22 and middle cylindrical shape 48 of middle member 46. Left protruding ring 50 may be sized larger than left pivot hole 42 of target holder 16 where left protruding ring 50 may not go through left pivot hole 42 of target holder 16. Likewise, right protruding ring 52 may be positioned between right cylindrical shape 40 of right extended member 26 and middle cylindrical shape 48 of middle member 46. Right protruding ring 52 may be sized larger than right pivot hole 44 of target holder 16 where right protruding ring 52 may not go through right pivot hole 44 of target holder 16. As a result, the combination of left protruding ring 50 and right protruding may be configured to center and maintain solid one-piece target apparatus 12 in target holder 16, as shown in FIGS. 1-2, 4 and 6.

Referring specifically back to FIGS. 5A-5D, first target 30 and second target 34 may be included with target apparatus 12. However, the disclosure is not so limited to a first and second target and any number of targets may be included with target apparatus 12. First target 30 may extend from first side 32 of central portion 20, and second target 34 may extend from second side 36 of central portion 20. In select embodiments of the disclosed self-healing reactive shooting target 10 disclosed herein, first side 32 with first target 30 extending therefrom may be opposed 180 degrees from second side 36 with second target 34 extending therefrom. Whereby, first target 30 extends in opposite direction 54 from central portion 20 of second target 34, as shown in FIGS. 1-8. In select embodiments, first target 30 may include first spacing member 56 configured to connect first target 30 to first side 32 of central portion 20 at first distance 58 from central portion 20, and second target 34 may include second spacing member 60 configured to connect second target 34 to second side 36 of central portion 20 at second distance 62 from central portion 20. See FIGS. 5 and 7. In select embodiments, first target 30 with first spacing member 56 may be sized 15-20% lighter than second target 34 with second spacing member 60, whereby solid one-piece target apparatus 12 may spin evenly about central portion 20 and return to a vertical position after being shot. As such, various sizes and shapes of targets may be included with various size and shapes of first spacing member 56 with first distance 58 and second spacing member 60 with second distance 62.

Figures 5A, 5B, 5C, 5D:
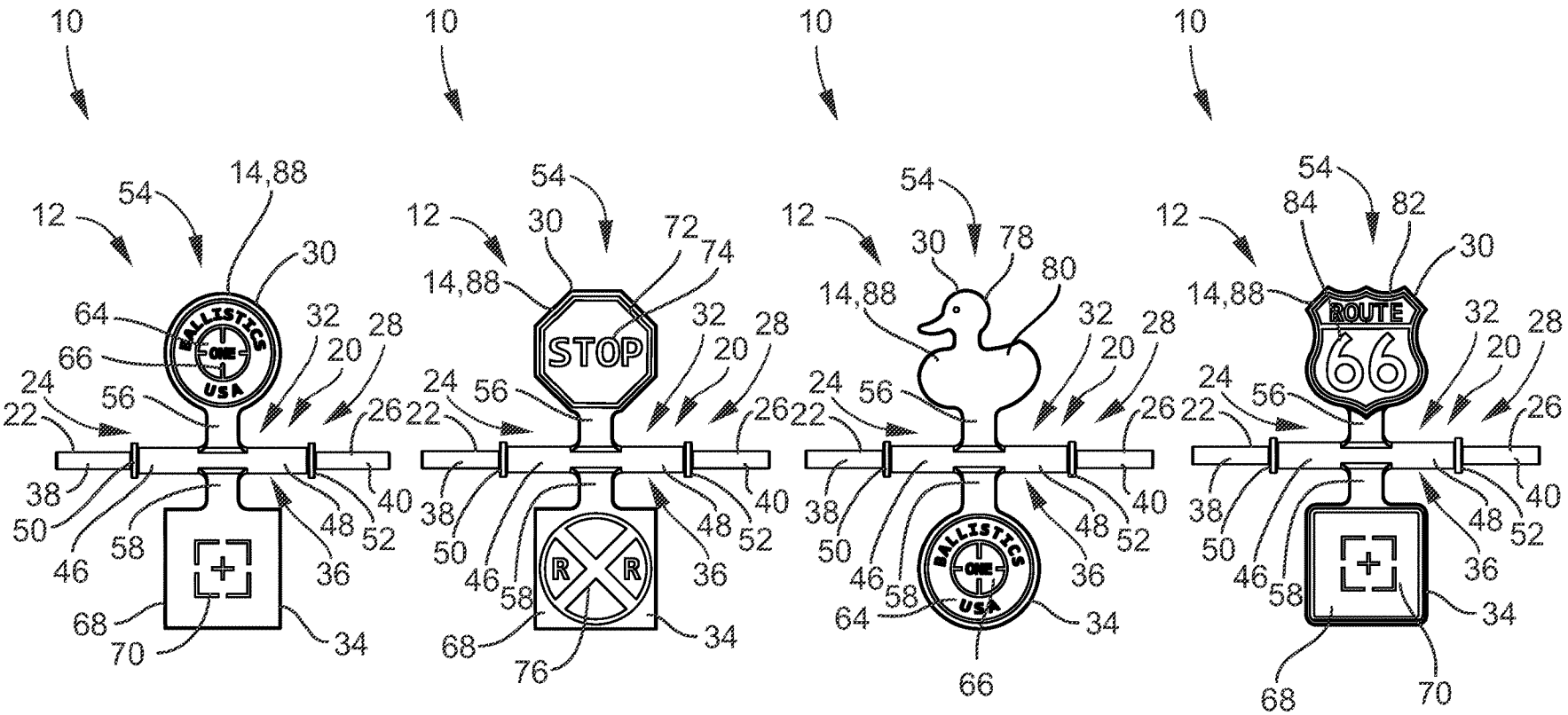
FIG. 5A is a front view of the solid one-piece target apparatus according to select embodiments where the target includes the circular shaped top target and the square shaped bottom target.
FIG. 5B is a front view of the solid one-piece target apparatus according to select embodiments where the target includes the stop sign shaped top target and the railroad crossing shaped bottom target.
FIG. 5C is a front view of the solid one-piece target apparatus according to select embodiments where the target includes the duck shaped top target and the circular shaped bottom target.
FIG. 5D is a front view of the solid one-piece target apparatus according to select embodiments where the target includes the highway shaped top target and the square shaped bottom target.
Figure 6:
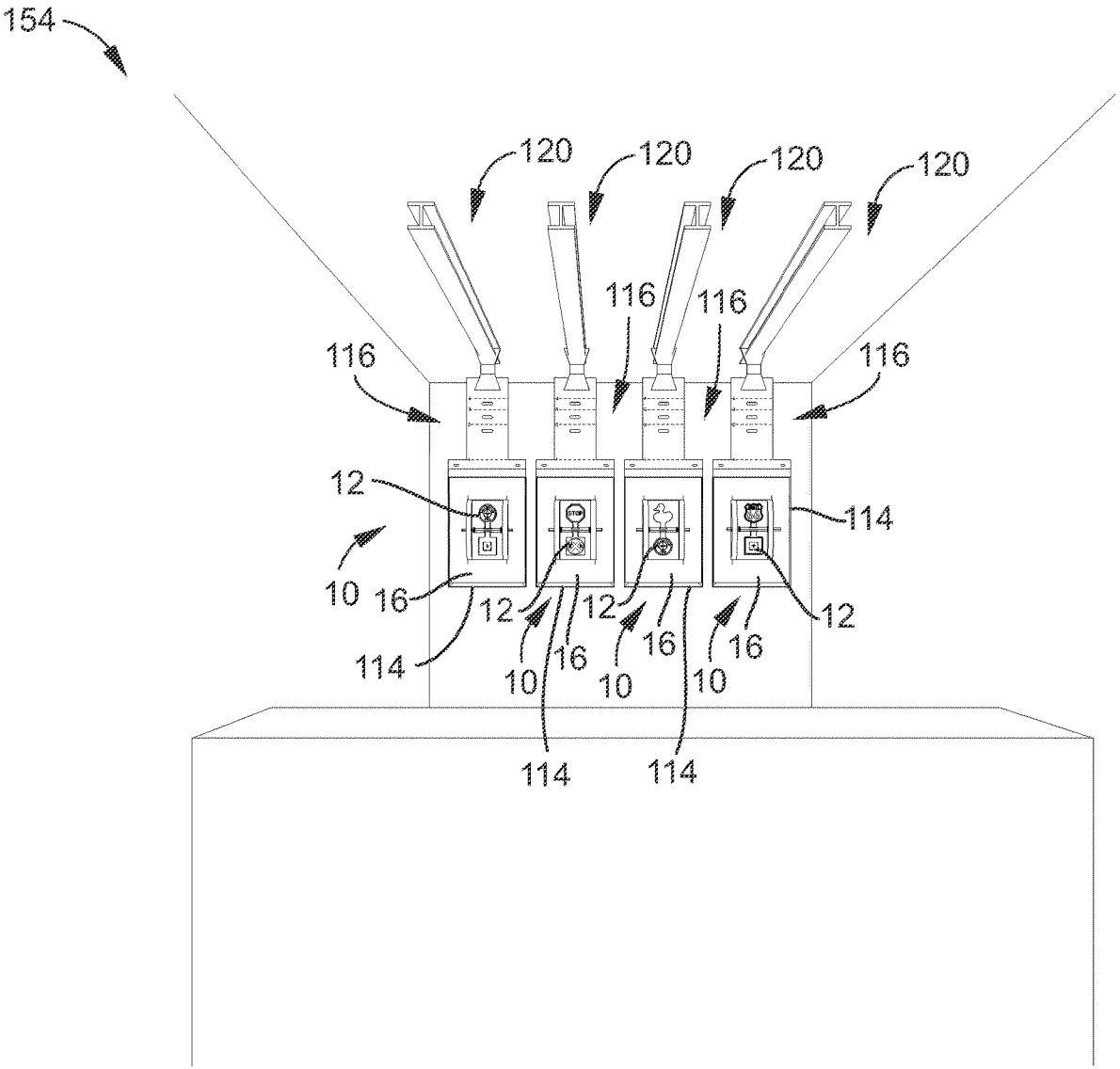
FIG. 6 is a perspective view of an indoor shooting range with four of the self-healing reactive shooting targets hung therein according to select embodiments of the instant disclosure.

Still referring specifically to FIGS. 5A-5D, another feature of the disclosed self-healing reactive shooting target 10 disclosed herein may be that first target 30 may be shaped, designed, or a combination thereof different from second target 34. However, the disclosure is not so limited, and in select embodiments, first target 30 may be shaped, designed, or a combination thereof the same as second target 34. As an example, as shown in FIGS. 1-4, 5A, and 6-8, in select embodiments, first target 30 may have circular shape 64 with circular target design 66 and second target 34 may have square shape 68 with square target design 70. As another example, as shown in FIGS. 5B and 6, in select other embodiments, first target 30 may have octagon shape 72 with stop sign design 74 and second target 34 may have square shape 68 with railroad crossing design 76. As yet another example, as shown in FIGS. 5C and 6, in yet other select embodiments, first target 30 may have duck shape 78 with duck design 80, and second target 34 may have circular shape 64 with circular target design 66. As yet another example, as shown in FIGS. 5D and 6, in yet other select embodiments, first target 30 may have highway sign shape 82 with route design 84, and second target 34 may have square shape 68 with square target design 70. In yet other select embodiments, first target 30 and/or second target 34 may have any various combinations of shapes and designs, as shown and/or described herein. However, the disclosure is not so limited, and other various shapes, sizes, and designs of targets may be included with target apparatus 12. For example, the first target 40 and/or second target 34 may have any words or slogans.

Target holder 16 may be included with self-healing reactive shooting target 10. See FIGS. 1-8. Target holder 16 may be for holding target apparatus 12 and allowing target apparatus 12 to react, rotate or spin therein. Target holder 16 may be constructed in any various or desired shape or size configured to hold target apparatus 12 and allow target apparatus 12 to react, rotate or spin therein. As such, target holder 16 may be configured to hold one-piece target apparatus 12. Target holder 16 may be made from any materials applicable for holding target apparatus 12. In select possibly preferred embodiments, target holder 16 may be made from tear resistant material 18. Solid one-piece target apparatus 12 may be configured to move about target holder 16 for providing reactive feedback when shot. As such, one feature of the instant disclosure of self-healing reactive shooting target 10 may be that solid one-piece target apparatus 12 may be configured to spin within target holder 16 for providing instant feedback when shot.

Figure 7:
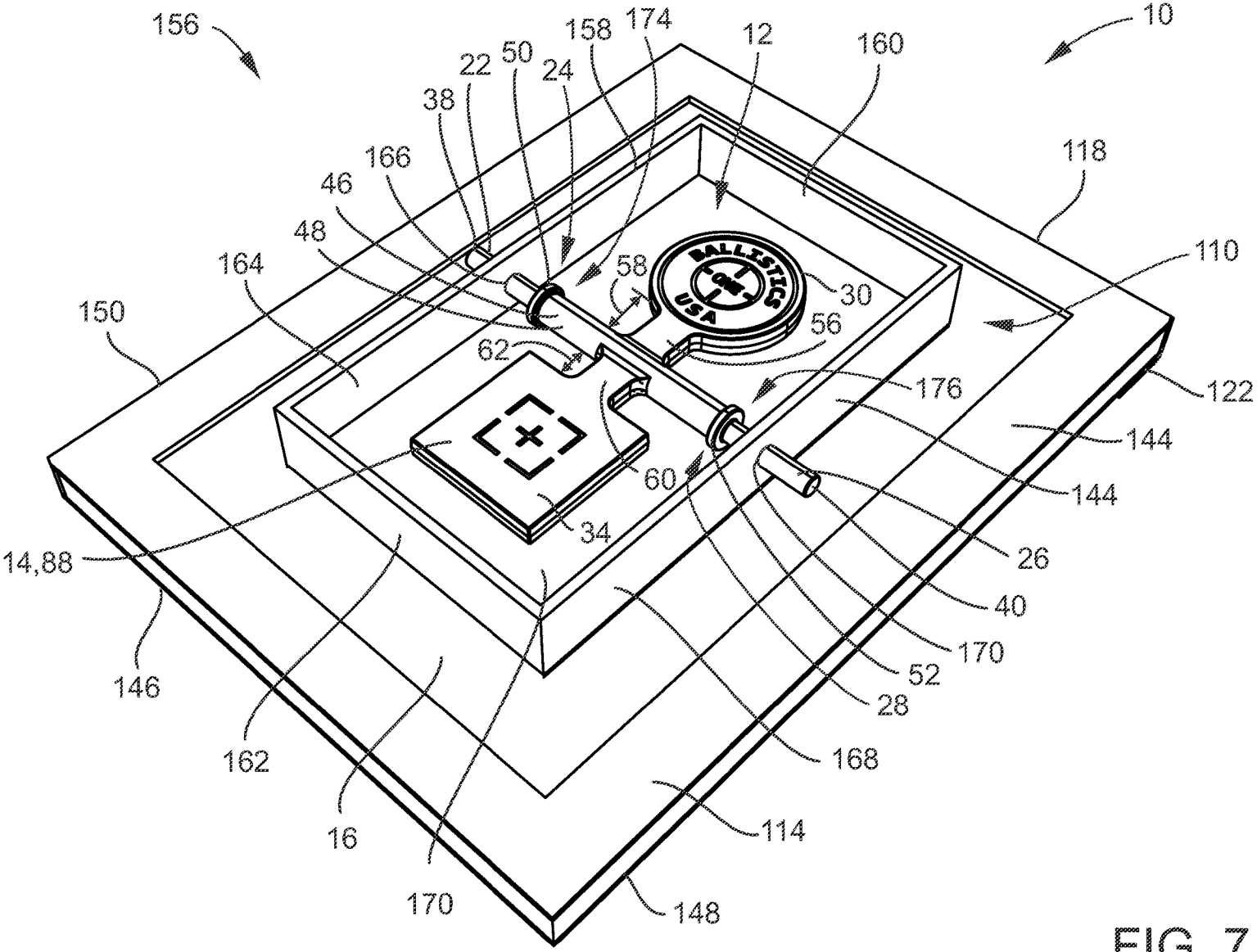
FIG. 7 is a perspective view of the self-healing reactive shooting target kit according to select embodiments of the instant disclosure.
Figure 8:
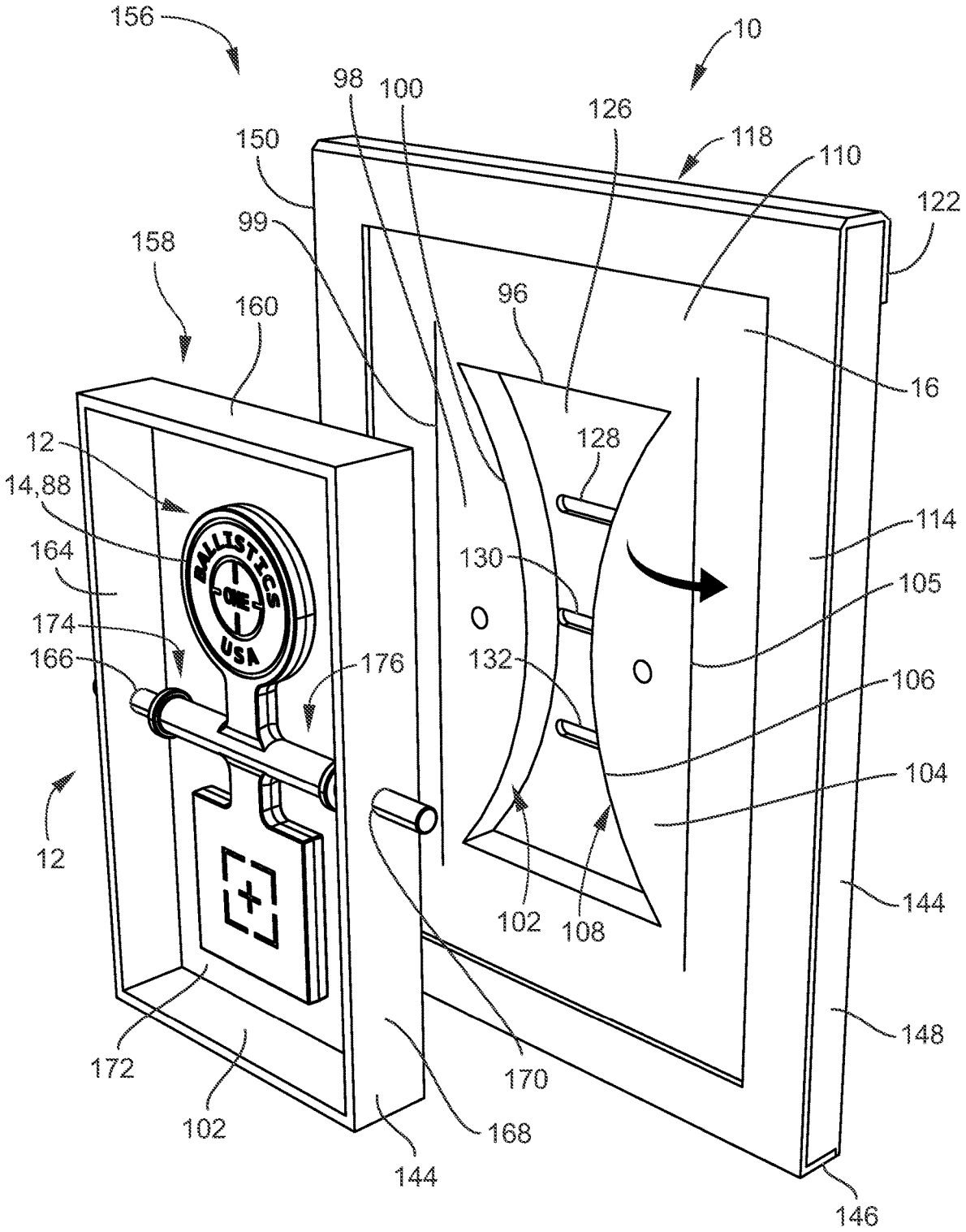
FIG. 8 is a perspective view of the self-healing reactive shooting target kit from FIG. 6 with the target box housing the solid one-piece target apparatus separated from the foam target holder in the frame with the hanging portion folded down.

Target holder 15 may be made from tear resistant material 18. Tear resistant material 18 may be any tear resistant material or any material that will hold its shape while being shot and/or while target apparatus 12 is shot and rotates or spins therein. In select embodiments, tear resistant material 18 of target holder 16 may include base foam 90 with higher density foam 92 laminated to one side, as shown in the Figures. In these embodiments, target holder 16 may include base rectangular shape 94 with hourglass shaped cutout 96 centered therein. In this embodiment, left hinging member 98 with left pivot hole 42 therethrough may be created from left convex portion 100 created by left hourglass side 102 of hourglass shaped cutout 96. To create this left hinging member 98, just base foam 90 and not higher density foam 92 laminated to one side may be cut to create left hinging member 98 that hinges via uncut section 99 of higher density foam 92 (uncut left section 99 shown in FIG. 8). Likewise, right hinging member 104 with right pivot hole 44 therethrough may be created from right convex portion 106 created by right hourglass side 108 of hourglass shaped cutout 96. To create this right hinging member 104, just the base foam 90 and not the higher density foam laminated to one side is cut to create the right hinging member 104 that hinges via uncut right section 105 of higher density foam 92 (uncut right section 105 shown in FIGS. 1, 3, 8). As a result, as shown in FIGS. 7 and 8, when left hinging member 98 and right hinging member 104 are folded down, target holder 16 may be in flat position 110 for storage or transportation. And, as shown in FIGS. 1-6, when left hinging member 98 and right hinging member 104 are folded out, target holder 16 may be in target receiving position 112. Target receiving position 112 may be where left pivot hole 42 of left hinging member 98 may be configured to receive left extended member 22 of central portion 20 of solid one-piece target apparatus 12 and right pivot hole 44 of right hinging member 104 may be configured to receive right extended member 26 of central portion 20 of solid one-piece target apparatus 12, as best shown in FIG. 3. As an example, and clearly not limited thereto, base foam 90 may have a thickness of 1.00 inches and higher density foam 92 may have a thickness of 0.13 inches. As an example, and clearly not limited thereto, base foam 90 with higher density foam 92 laminated to one side thereto may be Stratocell® S Laminated Polyethylene foam provided by Sealed Air Corporation of Saddle Brook N.J.

Referring now to FIGS. 1-2, 4, 6 and 7-8, in select embodiments of the disclosed self-healing reactive shooting target 10, frame 114 may be included. Frame 114 may be for housing or providing support to maintain the structure of target holder 16. Frame 114 may also be for providing a means for hanging self-healing reactive shooting target 10, like for hanging in various retrieval systems 120 of indoor gun ranges 154. As another feature, frame 114 may be for storing, shipping, and displaying self-healing reactive shooting target 10 for purchase, rental, or the like. As such, frame 114 may be configured to surround target holder 16 and provide support or rigidity to target holder 16. One feature of the disclosed self-healing reactive shooting target 10 disclosed herein may be that, in select embodiments, frame 114 can include hanging portion 116. Hanging portion 116 may extend from top 118 of frame 114. Hanging portion 116 may be configured to hang self-healing reactive shooting target 10 to multiple indoor gun range 154 retrieval systems 120. Hanging portion 116 may also be configured to fold down on the back side of target holder 16 for storage, transportation and displaying of self-healing reactive shooting target 10, as shown in FIGS. 7-8. In select embodiments, hanging portion 116 of frame 114 may include first wide extension portion 122 with pair of wide holes 124. First wide extension portion 122 may extend off of top 118 of frame 114. In select embodiments, second extension portion 126 may be included with hanging portion 116 of frame 114. Second extension portion 126 may extend off of first wide extension portion 122. In select embodiments, second extension portion 126 may include first slot 128, second slot 130, and third slot 132 therethrough. Wide holes 124, first slot 128, second slot 130, and third slot 132 may be designed and positioned to work with most known retrieval systems 120 of indoor gun ranges 154. Another feature may be that in select embodiments cutting grid 134 may be included on hanging portion 116 of frame 114. Cutting grid 134 may provide indications of cutting locations for use with various retrieval systems 120, like for use with wide holes 124, first slot 128, second slot 130, and/or third slot 132 Cutting grid 134 may be printed or the like on the front side of hanging portion 116 of frame 114. In select embodiments, cutting grid 134 may include first dashed cutting line 136, second dashed cutting line 138, third dashed cutting line 140 and fourth dashed cutting line 142. First dashed cutting line 136 may be for indicating a first cutting location for cutting hanging portion 116 for use with wide holes 124 on first wide extension portion 122. Second dashed cutting line 138 may be for indicating second cutting location for cutting the hanging portion 116 for use with the first slot 128. Third dashed cutting line 140 may be for indicating a third cutting location for cutting hanging portion 116 for use with second slot 130. Fourth dashed cutting line 142 may be for indicating a fourth cutting location for cutting hanging portion 116 for use with third slot 132.

Frame 114 may be made from any suitable materials for supporting and holding target holder 16. In select embodiments, as shown in the Figures, frame 114 may be made from cardboard 144. With use of cardboard 144 or the like for frame 114, frame 114 may include folded bottom side 146, folded right side 148, and folded left side 150. The combination of folded bottom side 146, folded right side 148, and folded left side 150 may create holder slot 152 configured for receiving target holder 16. This holder slot 152 of frame 114 may house and provide the necessary structure and rigidity for target holder 16, like the necessary structure and support of base foam 90 with higher density foam 92, which may tend to warp or sag.

Referring specifically to FIG. 6, another feature of the disclosed self-healing reactive shooting target 10 may be that it can be configured for safe use inside indoor gun range 154. In other words, the entire self-healing reactive shooting target 10 may be configured to not ricochet bullets, thereby making it safe for use inside indoor gun range 154. However, the disclosure is not so limited to use in indoor gun range 154 or the like, and self-healing reactive shooting target 10 and/or target apparatus 12 may be used in other locations, including outdoors, like with a different frame or hanging system.

Referring now specifically to FIGS. 7-8, in another aspect, the instant disclosure embraces self-healing reactive target kit 156. Self-healing reactive target kit 156 may be a collection of materials that are sold together, or separately as replacement parts, that may be used for creating self-healing reactive shooting target 10. As such, kit 156 may include solid one-piece target apparatus 12 in any of the various embodiments shown and/or described herein, target holder 16 in any of the various embodiments shown and/or described herein, frame 114 in any of the various embodiments shown and/or described herein, target box 158, and any various combinations thereof. Target box 158 may be configured to store solid one-piece target apparatus 12 during transportation, storage, or display. In select embodiments of the disclosed self-healing reactive shooting target kit 156, target box 158 may be made from cardboard 144. In other select embodiments of self-healing reactive shooting target kit 156, as shown in FIGS. 7-8, target box 158 may include top edge 160, bottom edge 162, left edge 164, right edge 168 and backing 172. Left edge 164 may have left box hole 166 configured to receive left extended member 22 of solid one-piece target apparatus 12. Right edge 168 may have right box hole 170 configured to receive right extended member 26 of solid one-piece target apparatus 12. Backing 172 may have left box slot 174 configured to receive left protruding ring 50 of solid one-piece target apparatus 12, and right box slot 176 configured to receive right protruding ring 52 of solid one-piece target apparatus 12. Wherein, target box 158 may be configured to securely house solid one-piece target apparatus 12.

In sum, the present disclosure of self-healing reactive shooting target 10 may be directed to providing an immediate target feedback at indoor gun range 154. All of the material used in creating self-healing reactive shooting target 10 may allow for hundreds of shots to pass therethrough, which may allow the target to be reused numerous times. In addition, self-healing reactive shooting target 10 does not contain any metal or hard plastics decreasing or illuminating the risk of bullet ricochet and possible injury to the shooter.

A feature of the present disclosure of self-healing reactive shooting target 10 may be that target apparatus 12 spins as it is hit with a bullet, giving the shooter instant feedback of a positive hit.

Another feature of the present disclosure of self-healing reactive shooting target 10 may be its ability to be used safely inside an indoor gun range, like indoor gun range 154 shown in FIG. 6, as there are no parts that would or could ricochet a bullet.

Another feature of the present disclosure of self-healing reactive shooting target 10 may be its ability to be attached to nearly all indoor gun range retrieval systems 120.

Another feature of the present disclosure of self-healing reactive shooting target 10 may be that the target pivot point is at each side of target apparatus 12. All other known spinning targets pivot at the center of the target on a fixed rod made of medal or plastic. If a single bullet hits the pivot point on those targets, damage can occur to the rod, either bending the rod or causing a burr at the bullet exit point causing friction between the target and the rod. This may result in the target not spinning or not spinning correctly. The present disclosure of self-healing reactive shooting target 10 solves these previous problems by being manufactured from a solid piece of cast urethane whereby the target and rod created by the central portion 20 spin as a single unit. The rod created by the central portion 20 of target apparatus 12 may be inserted into 2 pivot holes 42 and 44 on left and right hinging members 98 and 104 made of tear resistant foam 90 and 92. As a result, this area can accept dozens and dozens of bullets passing through this pivot area without significant damage. Thus, making target apparatus 12 from a single piece that spins at the end vs spinning from the center is one of the key elements. If a bullet goes through the center of target apparatus 12 it continues to work, if a bullet goes through the center of any other target you would hit the metal frame and it would bend, causing it to stop working. For example, a commonly know spinning target has a plastic rod in the center vs metal, where it spins at the center on this plastic shaft, whereby plastic spins on plastic. Unlike the disclosed target apparatus 12, when a single bullet passes through this common spinning target, a small burr is created between the target and the shaft, causing it to stop working or spinning. Target apparatus 12 spins about left extended member 22 in left pivot hole 42 and right extended member 26 in right pivot hole 44, out of the path of most bullets. As such, if target apparatus 12 were to be hit, a small burr might also be created, but it is touching foam, which is much more forgiving, and it thus may keep working or spinning. As an example, 20 rounds can be shot through the same area at the end, where target apparatus still worked or was able to spin. In select embodiments and conditions, target apparatus 12 may be almost completely self-healing and thus almost never fail or stop spinning from being shot.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A self-healing reactive target comprising:

a solid one-piece target apparatus made from a self-healing material, and a target holder configured to hold the one-piece target apparatus, the target holder is made from a tear resistant material, the tear resistant material of the target holder includes a base foam with a higher density foam laminated to one side, wherein the target holder including a base rectangular shape with an hourglass shaped cutout centered therein;

a left hinging member with a left pivot hole therethrough, the left hinging member is created from a left convex portion created by a left hourglass side of the hourglass cutout, where just the base foam and not the higher density foam laminated to one side is cut to create the left hinging member that hinges via an uncut left section of the higher density foam; and a right hinging member with a right pivot hole therethrough, the right hinging member is created from a right convex portion created by a right hourglass side of the hourglass cutout, where just the base foam and not the higher density foam laminated to one side is cut to create the right hinging member that hinges via an uncut right section of the higher density foam;

wherein, the solid one-piece target apparatus is configured to move about the target holder for providing reactive feedback when shot.

2. The self-healing reactive target of claim 1, wherein the solid one-piece target apparatus is configured to spin within the target holder for providing instant feedback when shot.

3. The self-healing reactive target of claim 1, wherein the solid one-piece target apparatus including:

a central portion including:

a left extended member extending from a left side of the central portion; and a right extended member extending from a right side of the central portion;

wherein, the left extended member and the right extended member are configured for positioning the solid one-piece target apparatus in the target holder;

a first target extending from a first side of the central portion; and a second target extending from a second side of the central portion.

4. The self-healing reactive target of claim 3, wherein:

the left extended member having a left cylindrical shape; and the right extended member having a right cylindrical shape;

wherein, the left cylindrical shape of the left extended member is configured to be inserted into a left pivot hole of the target holder, and the right cylindrical shape of the right extended member is configured to be inserted into a right pivot hole of the target holder;

wherein the solid one-piece target apparatus is configured to spin about the target holder via the left cylindrical shape of the left extended member rotating in the left pivot hole of the target holder, and the right cylindrical shape of the right extended member rotating in the right pivot hole of the target holder.

5. The self-healing reactive target of claim 4, wherein the central portion including:

a middle member positioned between and interconnecting the left extended member with the right extended member, wherein the middle member has a middle cylindrical shape, where the middle cylindrical shape is larger than the left cylindrical shape of the left extended member and the right cylindrical shape of the right extended member;

a left protruding ring positioned between the left cylindrical shape of the left extended member and the middle cylindrical shape of the middle member, the left protruding ring is sized larger than the left pivot hole of the target holder where the left protruding ring will not go through the left pivot hole of the target holder; and a right protruding ring positioned between the right cylindrical shape of the right extended member and the middle cylindrical shape of the middle member, the right protruding ring is sized larger than the right pivot hole of the target holder where the right protruding ring will not go through the right pivot hole of the target holder;

wherein, a combination of the left protruding ring and the right protruding are configured to center and maintain the solid one-piece target apparatus in the target holder.

6. The self-healing reactive target of claim 3, wherein the first side with the first target extending therefrom is opposed from the second side with the second target extending therefrom, whereby the first target extends in an opposite direction from the central portion of the second target, wherein:

the first target includes a first spacing member configured to connect the first target to the first side of the central portion at a first distance from the central portion; and the second target includes a second spacing member configured to connect the second target to the second side of the central portion at a second distance from the central portion;

wherein the first target with the first spacing member is sized 15-20% lighter than the second target with the second spacing member, whereby the solid one-piece target apparatus spins evenly about the central portion and returns to a vertical position after being shot.

7. The self-healing reactive target of claim 3, wherein the first target is shaped, designed, or a combination thereof different from the second target; wherein:

the first target has a circular shape with a circular target design and the second target has a square shape with a square target design;

the first target has an octagon shape with a stop sign design and the second target has the square shape with a railroad crossing design;

the first target has a duck shape with a duck design, and the second target has the circular shape with the circular target design;

the first target has a highway sign shape with a route design, and the second target has the square shape with the square target design; or combinations thereof.

8. The self-healing reactive target of claim 7, wherein the self-healing material of the solid one-piece target apparatus is a polyurethane material cast into the shape and design of the solid one-piece target apparatus, wherein the polyurethane material includes:

a hardness of 89-90 A;

a 100% modulus of 1100 psi a 300% modulus of 1300 psi;

a tensile of 3000 psi;

an elongation percentage of 530%;

a tear resistance with a split of 70 pli and a Die C of 450 pli;

a compression set percentage of 19% with a method B of 25% deflection at 22 hours and 70° C.;

a rebound percentage of 59%; and a specific gravity of 1.06.

9. The self-healing reactive target of claim 1, wherein:

when the left hinging member and the right hinging member are folded down, the target holder is in a flat position for storage or transportation; and when the left hinging member and the right hinging member are folded out, the target holder is in a target receiving position, where the left pivot hole of the left hinging member is configured to receive a left extended member of a central portion of the solid one-piece target apparatus and the right pivot hole of the right hinging member is configured to receive a right extended member of the central portion of the solid one-piece target apparatus.

10. The self-healing reactive target of claim 1 further including:

a frame configured to surround the target holder and provide support or rigidity to the target holder.

11. The self-healing reactive target of claim 10, wherein the frame including a hanging portion extending from a top of the frame, the hanging portion is configured to hang the self-healing reactive target to multiple indoor gun range retrieval systems.

12. The self-healing reactive target of claim 11, wherein the hanging portion of the frame including:

a first wide extension portion with a pair of wide holes, the first wide extension portion extending off of the top of the frame;

a second extension portion extending off of the first wide extension portion, the second extension portion including a first slot, a second slot, and a third slot therethrough; and a cutting grid including:

a first dashed cutting line for cutting the hanging portion for use with the wide holes on the first wide extension portion;

a second dashed cutting line for cutting the hanging portion for use with the first slot;

a third dashed cutting line for cutting the hanging portion for use with the second slot; and a fourth dashed cutting line for cutting the hanging portion for use with the third slot.

13. The self-healing reactive target of claim 12, wherein the frame is made from cardboard, where the cardboard frame includes:

a folded bottom side;

a folded right side; and a folded left side;

wherein, a combination of the folded bottom side, the folded right side, and the folded left side create a holder slot configured for receiving the target holder.

14. The self-healing reactive target of claim 1, wherein the self-healing reactive target is configured for safe use inside an indoor gun range where the entire self-healing reactive target is configured to not ricochet bullets.

15. A self-healing reactive target kit comprising:

a solid one-piece target apparatus made from a self-healing material, and a target holder configured to hold the one-piece target apparatus, the target holder is made from a tear resistant foam material;

a frame configured to surround the target holder and provide support or rigidity to the target holder; and a target box configured to store the solid one-piece target apparatus during transportation or storage, wherein the target box is made from cardboard and includes:

a top edge;

a bottom edge;

a left edge with a left box hole configured to receive a left extended member of the solid one-piece target apparatus;

a right edge with a right box hole configured to receive a right extended member of the solid one-piece target apparatus; and a backing with a left box slot configured to receive a left protruding ring of the solid one-piece target apparatus, and a right box slot configured to receive a right protruding ring of the solid one-piece target apparatus, wherein, the target box is configured to securely house the solid one-piece target apparatus;

wherein, the solid one-piece target apparatus is configured to move about the target holder for providing reactive feedback when shot.

16. A self-healing reactive target comprising:

a solid one-piece target apparatus made from a self-healing material, a target holder configured to hold the one-piece target apparatus, the target holder is made from a tear resistant material; and a frame configured to surround the target holder and provide support or rigidity to the target holder, the frame including a hanging portion extending from a top of the frame, the hanging portion is configured to hang the self-healing reactive target to multiple indoor gun range retrieval systems, the hanging portion of the frame including:

a first wide extension portion with a pair of wide holes, the first wide extension portion extending off of the top of the frame;

a second extension portion extending off of the first wide extension portion, the second extension portion including a first slot, a second slot, and a third slot therethrough; and a cutting grid including:

a first dashed cutting line for cutting the hanging portion for use with the wide holes on the first wide extension portion;

a second dashed cutting line for cutting the hanging portion for use with the first slot;

a third dashed cutting line for cutting the hanging portion for use with the second slot; and a fourth dashed cutting line for cutting the hanging portion for use with the third slot;

wherein, the solid one-piece target apparatus is configured to move about the target holder for providing reactive feedback when shot.

17. The self-healing reactive target of claim 16, wherein the frame is made from cardboard, where the cardboard frame includes:

a folded bottom side;

a folded right side; and a folded left side;

wherein, a combination of the folded bottom side, the folded right side, and the folded left side create a holder slot configured for receiving the target holder.

* * * * *